US009004951B2

(12) United States Patent
Wu et al.

(10) Patent No.: US 9,004,951 B2
(45) Date of Patent: Apr. 14, 2015

(54) MULTI-FUNCTIONAL TRANSFER CONNECTOR FOR CONNECTING WITH DIFFERENT RECEPTACLES

(71) Applicant: Hon Hai Precision Industry Co., Ltd., New Taipei (TW)

(72) Inventors: Zhuang-Zhi Wu, Kunshan (CN); Xue-Chao Wang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 14/052,918

(22) Filed: Oct. 14, 2013

(65) Prior Publication Data

US 2014/0106590 A1 Apr. 17, 2014

(30) Foreign Application Priority Data

Oct. 15, 2012 (CN) ..... 2012 1 0389307

(51) Int. Cl.
*H01R 25/00* (2006.01)
*H01R 27/00* (2006.01)
*H01R 24/62* (2011.01)

(52) U.S. Cl.
CPC ..... *H01R 27/00* (2013.01); *H01R 24/62* (2013.01)

(58) Field of Classification Search
CPC ..... H01R 23/7068; H01R 35/04
USPC ..... 439/638, 640, 660, 172, 171
See application file for complete search history.

(56) References Cited

U.S. PATENT DOCUMENTS

| | | | | |
|---|---|---|---|---|
| 7,121,852 | B2 | 10/2006 | Ng et al. | |
| 7,473,141 | B2 | 1/2009 | Liao | |
| 7,811,136 | B1 * | 10/2010 | Hsieh et al. | 439/640 |
| 7,824,186 | B2 * | 11/2010 | Zhao et al. | 439/13 |
| 7,909,624 | B2 * | 3/2011 | Iida | 439/131 |
| 8,118,616 | B1 * | 2/2012 | Clark | 439/640 |
| 8,550,856 | B2 | 10/2013 | Lin | |
| 8,737,064 | B2 * | 5/2014 | Son et al. | 361/679.59 |
| 8,770,997 | B2 * | 7/2014 | Yu et al. | 439/164 |
| 2014/0106590 | A1 * | 4/2014 | Wu et al. | 439/284 |
| 2014/0127937 | A1 * | 5/2014 | Huang | 439/534 |
| 2014/0213110 | A1 * | 7/2014 | Wu et al. | 439/607.22 |

* cited by examiner

*Primary Examiner* — Phuongchi T Nguyen
(74) *Attorney, Agent, or Firm* — Ming Chieh Chang; Wei Te Chung

(57) ABSTRACT

A multi-functional transfer connector for connecting with different receptacles includes a first insulative housing (11), a first plug (12) and a first receptacle (13) retained in the first insulative housing, a base insulative housing (31), and a base plug (32) retained in the base insulative housing. The base insulative housing defines a peripherally closed receiving space (310) to receive the first insulative housing, the first plug, and the first receptacle. The first plug and the first receptacle are located at the opposite sides of the first insulative housing. A cable (4) is located at opposite, outer sides of the receiving space with respect to the base plug. The cable includes individual wires electrically connecting in parallel to the first plug, the first receptacle, and the base plug directly.

19 Claims, 7 Drawing Sheets

MULTI-FUNCTIONAL TRANSFER CONNECTOR FOR CONNECTING WITH DIFFERENT RECEPTACLES

BACKGROUND OF THE INVENTION

1. Field of the Invention

The present invention relates to a multi-functional transfer connector, and more particularly to a multi-functional transfer connector for connecting with different receptacles.

2. Description of Related Art

U.S. Pat. No. 7,121,852 issued on Oct. 17, 2006 discloses a connector structure comprising a body, a first (plug or receptacle) connector at one end of the body, a rotating element pivotally connected to the body, and a second (plug or receptacle) connector pivotally disposed with respect to the body by the rotating element. An optional multi-linking-movement switch, through specific rotation angles thereof, is capable of controlling electric conduction of the first connector and the second connector.

U.S. Pat. No. 7,473,141 issued on Jan. 6, 2009 discloses a multi-functional transfer connector including a first insulative housing, a first plug and a first receptacle both retained by the first insulative housing, a second insulative housing, and a second plug retained by the second insulative housing. The first insulative housing has two pivotal side arms for effectuating a relative movement between the first and second insulative housings. The first plug and the first receptacle are connected electrically. The second plug is located in the front of the second insulative housing. The first plug and the second plug are of different kinds for connecting with different receptacles of a variety of electronic devices. When the second plug is used, the second plug is inserted into the receptacle of the device directly. When the first plug is used, the first receptacle receives the second plug first, then the first plug is inserted into a device receptacle.

U.S. Pat. No. 8,550,856 issued on Oct. 8, 2013 discloses a transfer plug assembly which includes a first plug, first flexible link, second flexible link, and a second plug. Respective first ends of the first flexible link and the second flexible link are connected to two lateral sides of the first plug. Respective second ends of the first flexible link and the second flexible link are connected to two lateral sides of the second plug. Through the linking of the first and second flexible links, the second plug will hang around the first plug and is accessible nearby.

Hence, an improved multi-functional transfer connector is desired.

BRIEF SUMMARY OF THE INVENTION

Accordingly, an object of the present invention is to provide a multi-functional transfer connector for connecting with different receptacles.

The present invention provides a multi-functional transfer connector for connecting with different receptacles includes a first insulative housing, a first plug and a first receptacle retained in the first insulative housing, a base insulative housing, and a base plug retained in the base insulative housing. The base insulative housing defines a peripherally closed receiving space to receive the first insulative housing, the first plug, and the first receptacle. The first plug and the first receptacle are located at the opposite sides of the first insulative housing. A cable is located at opposite, outer sides of the receiving space with respect to the base plug. The cable includes individual wires electrically connecting in parallel to the first plug, the first receptacle, and the base plug directly.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
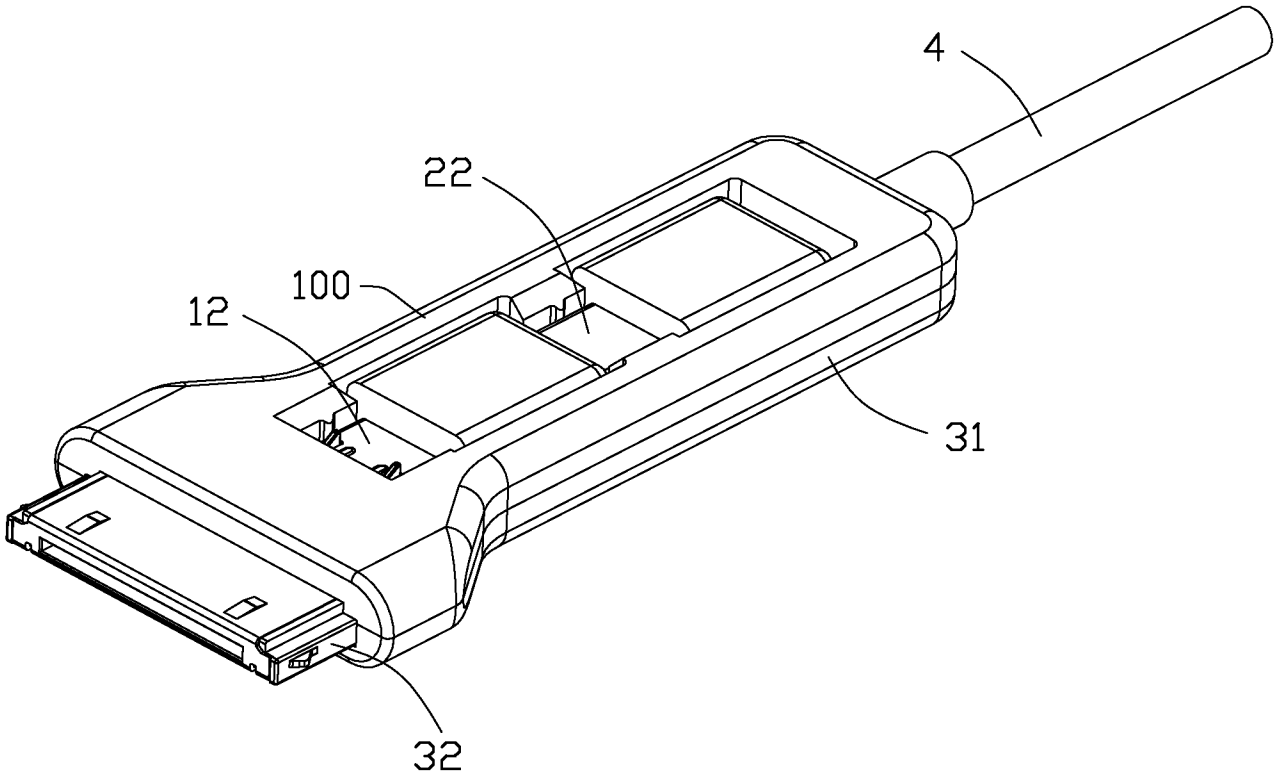
FIG. 1 is a perspective, assembled view of a multi-functional transfer connector and a cable according to the present invention.
Figure 2:
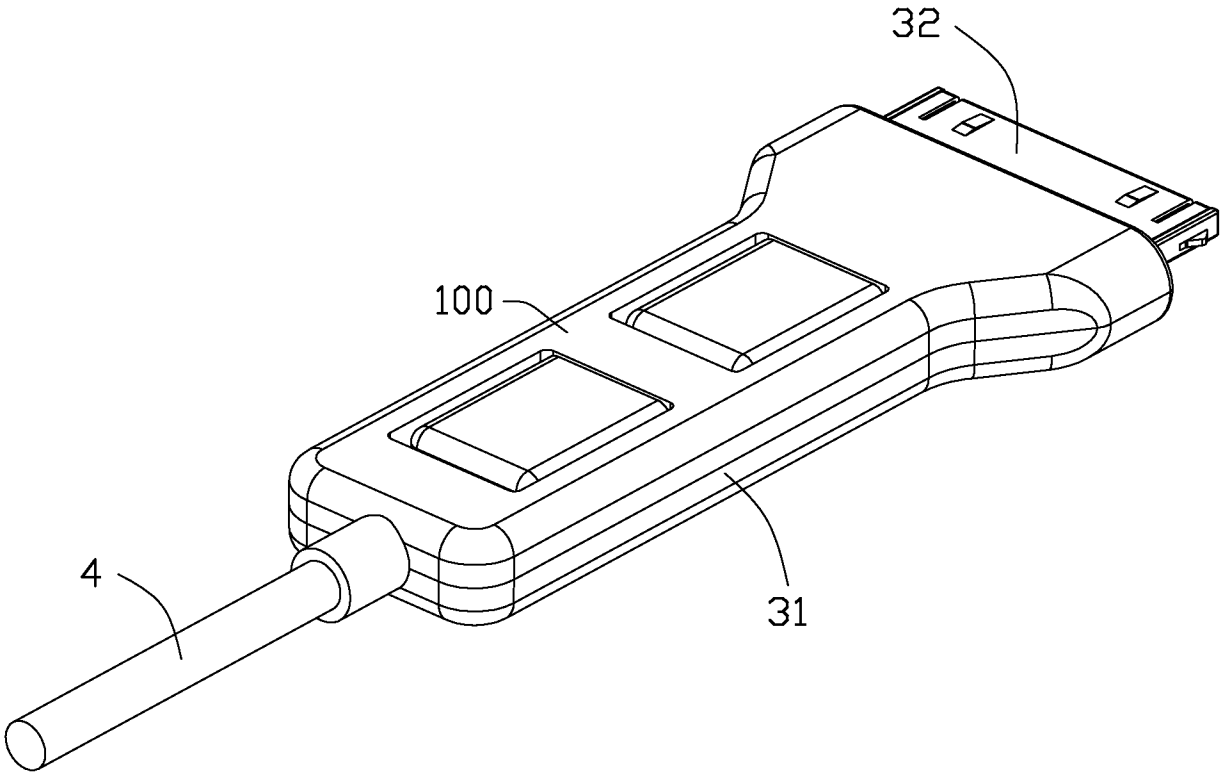
FIG. 2 is another assembled view similar to FIG. 1, taken from another aspect.

Reference will be made to the drawing figures to describe the present invention in detail, wherein depicted elements are not necessarily shown to scale and wherein like or similar elements are designated by same or similar reference numeral through the several views and same or similar terminology.

FIGS. 1 to 6 illustrate a multi-functional transfer connector 100 and a cable 4 in accordance to the present invention. The multi-functional transfer connector 100 includes a first insulative housing 11, a first plug 12 and a first receptacle 13 retained in the first insulative housing 11, a second insulative housing 21, a second plug 22 and a second receptacle 23 retained in the second insulative housing 21, a base insulative housing 31, and a base plug 32 retained in the base insulative housing 31.

Figure 3:
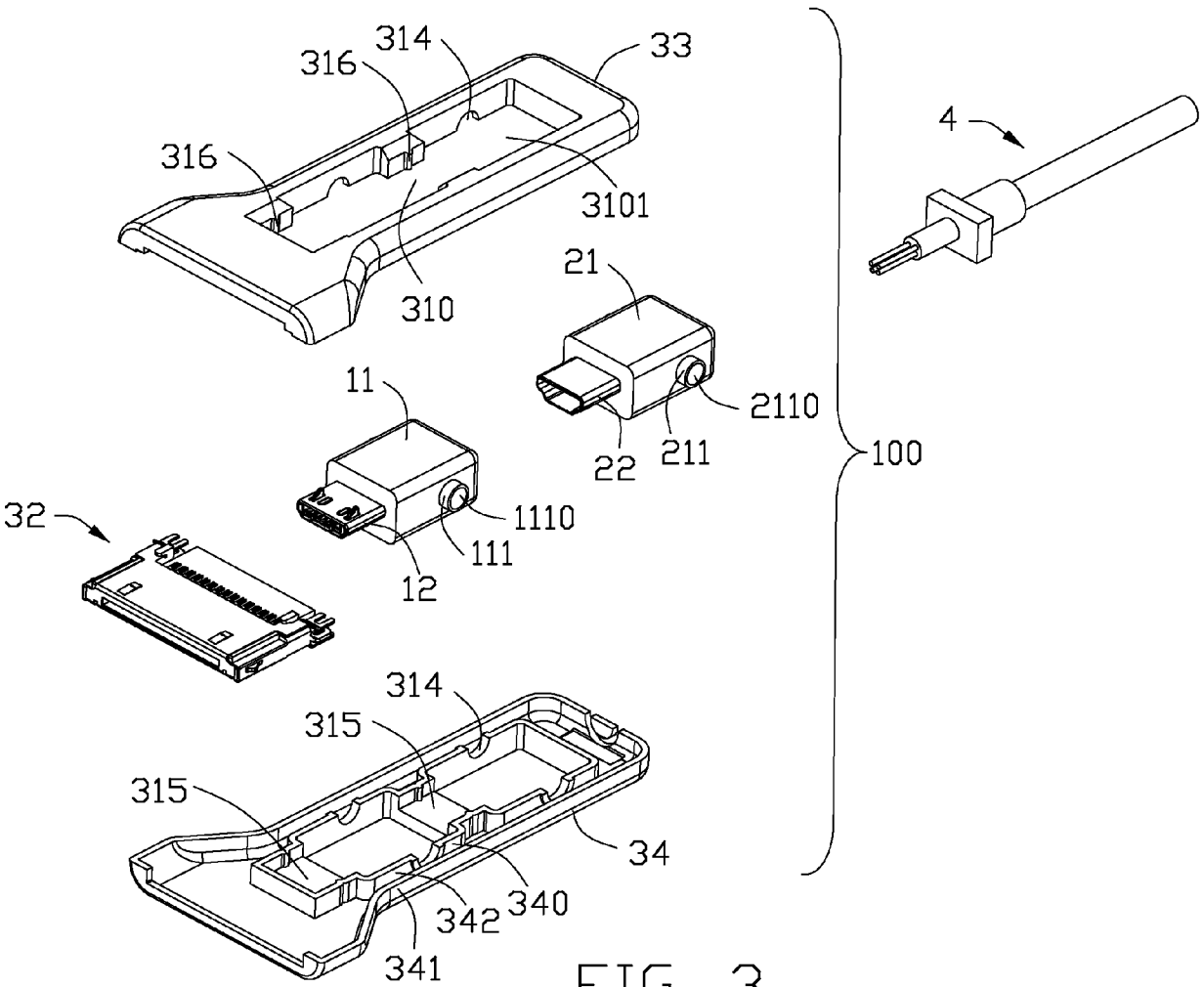
FIG. 3 is a perspective, exploded view of the multi-functional transfer connector and the cable.
Figure 4:
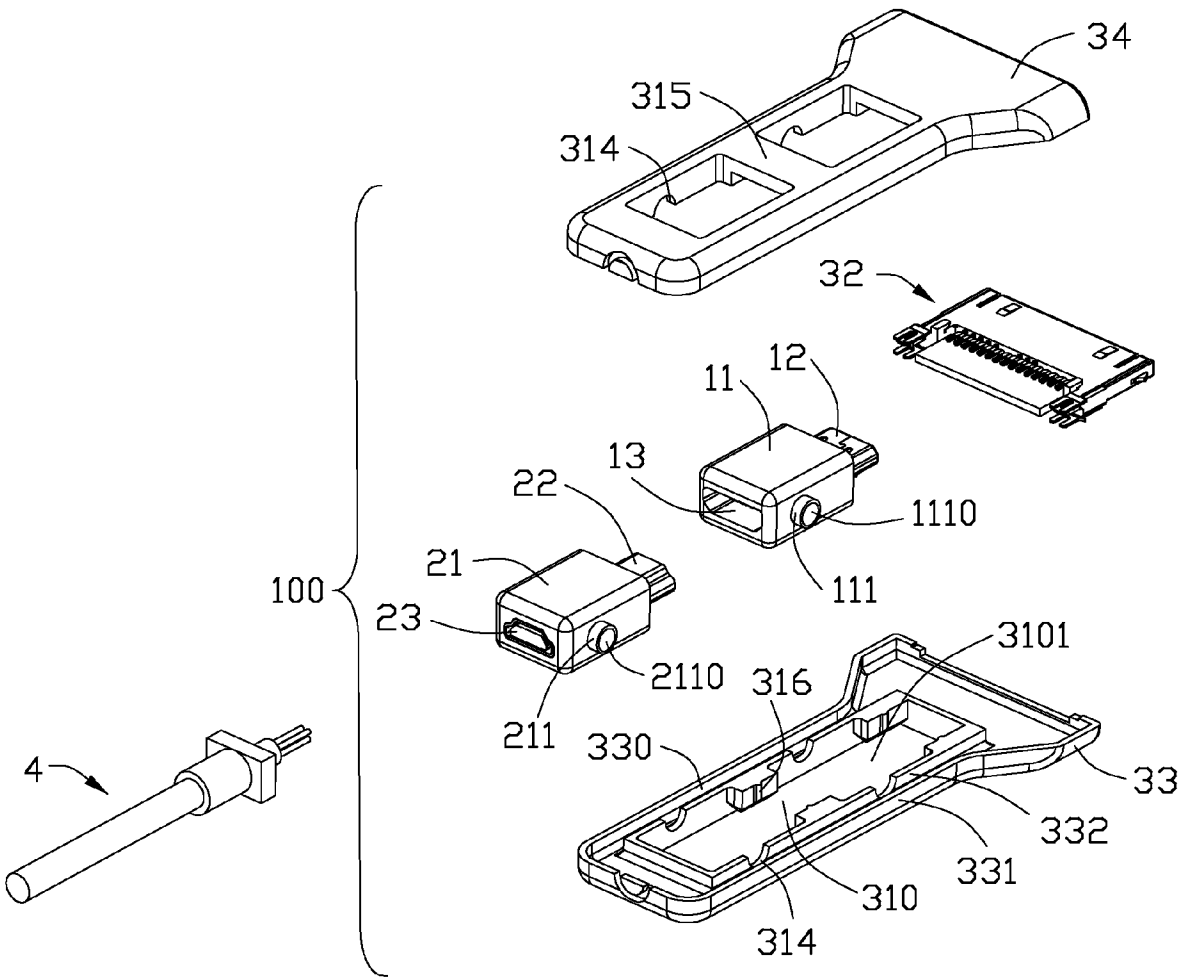
FIG. 4 is another exploded view similar to FIG. 3, taken from another aspect.
Figure 5:
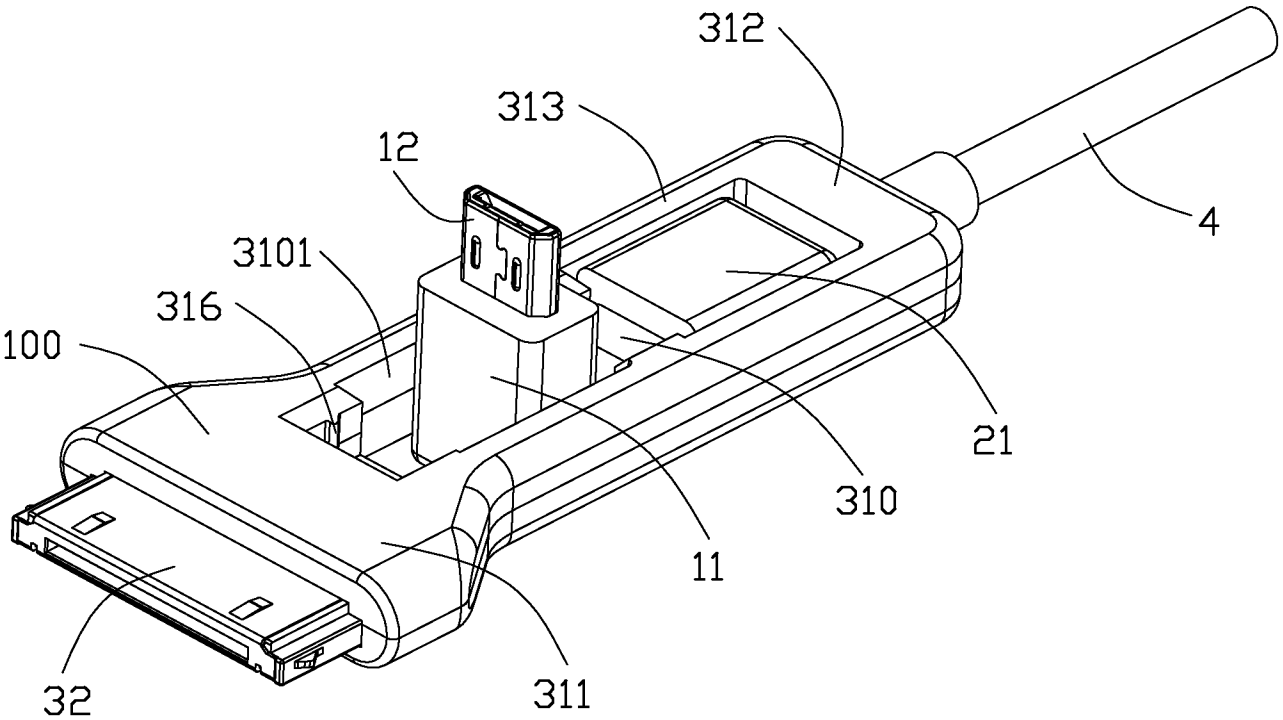
FIG. 5 is a perspective, assembled view of the multi-functional transfer connector and the cable in first usable state.
Figure 6:
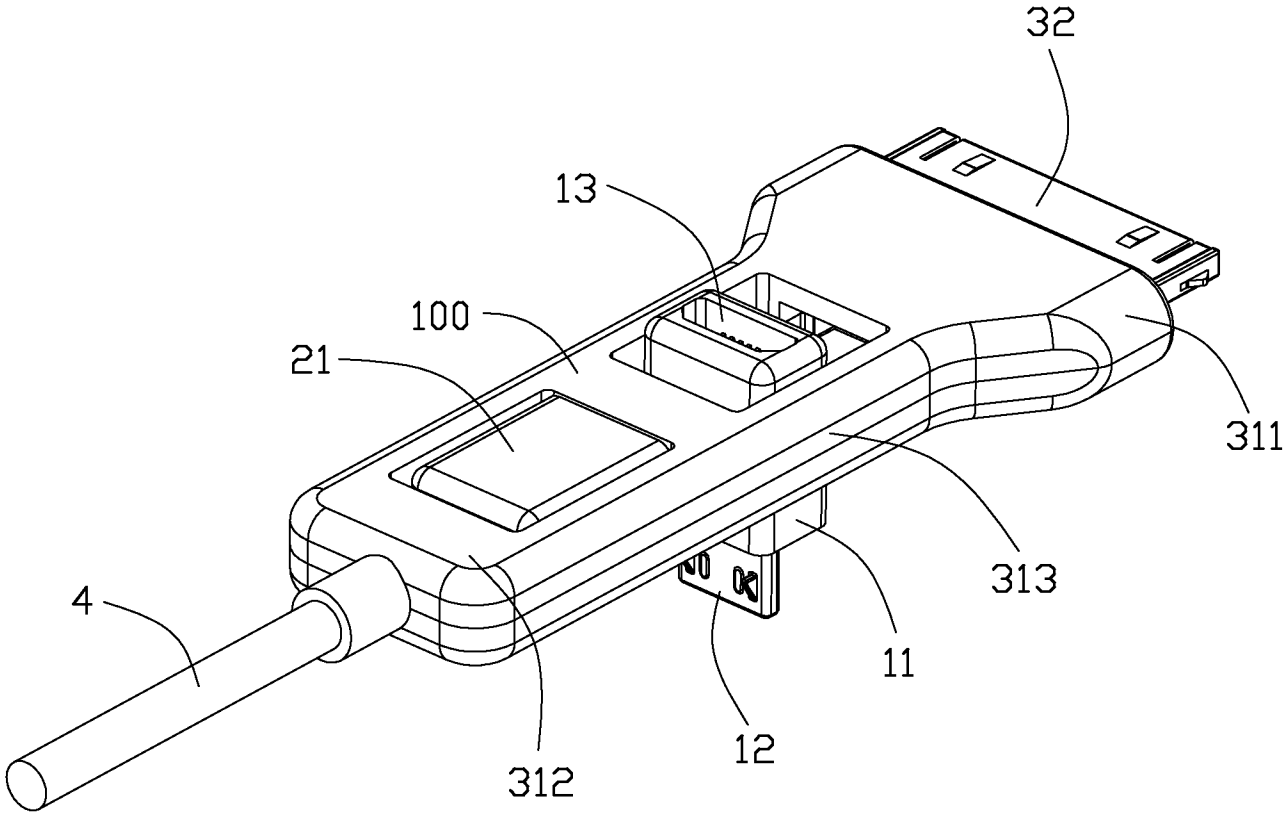
FIG. 6 is another assembled view similar to FIG. 5, taken from another aspect.

Referring to FIGS. 3 and 4, the first insulative housing 11 is rectangular. The first insulative housing 11 includes a pair of pivoted posts 111 on lateral surfaces to connect with the base insulative housing 31. The first insulative housing 11 defines a hole 1110 extending through the pivoted post 111 to let first wires (not shown) pass through the hole 1110. The first plug 12 is located in the front of the first insulative housing 11. The first receptacle 13 is located in the rear of the first insulative housing 11. The first plug 12 and the first receptacle 13 are connected electrically. The first plug 12 and the first receptacle 13 are connected with the cable 4 by the first wires. In detail, the first plug 12 and the first receptacle 13 are connected directly by connecting wires. And the first wires are connected with the connecting wires. As an alternate, the first plug 12, the first receptacle 13, and the first wires are connected by a printed circuit board disposed in the first insulative housing 11. Then the first wires are connected with the printed circuit board.

Referring to FIGS. 3 and 4, the second insulative housing 21 is similar to the first insulative housing 11 and is also rectangular. The second insulative housing 21 includes a pair of pivoted posts 211 on lateral surfaces to connect with the base insulative housing 31. The second insulative housing 21 defines a hole 2110 extending through the pivoted post 211 to let second wires (not shown) pass through the hole. The second plug 22 is located in the front of the second insulative housing 21. The second receptacle 23 is located in the rear of the second insulative housing 21. The second plug 22 and the second receptacle 23 are connected electrically. The second plug 22 and the second receptacle 23 are connected with the cable 4 by the second wires.

Referring to FIGS. 1 to 4, the base insulative housing 31 includes a front portion 311, a rear portion 312, and two arms 313 connecting the front portion 311 and the rear portion 312. The front portion 311 holds the base plug 32. The cable 4 is assembled to the rear portion 312. The front portion 311, the rear portion 312, and the arms 313 define a receiving space 310. The receiving space 310 includes two receiving rooms 3101 in communication with each other. One of the receiving rooms 3101 receives the first insulative housing 11. The other receiving room 3101 receives the second insulative housing 21. Each receiving room 3101 has a pair of opposing openings 314 in inner surfaces thereof. The openings 314 engage with the pivoted posts 111 and 211. So, the first insulative housing 11 and the second insulative housing 21 could rotate relative to the base insulative housing 31. In other embodiments, the first insulative housing 11 and the second insulative housing 21 include openings. The base insulative housing 31 includes pivoted posts corresponding to the openings. The openings 314 are located in the middle of the receiving rooms 3101. The pivoted posts 111 and 211 are respectively located in the middle of the first insulative housing 11 and the second insulative housing 21. Therefore, the first plug 12 and the second plug 22 respectively rotates out conveniently when a rear of the first insulative housing 11 or a rear of the second insulative housing 21 is pressed. Each receiving room 3101 includes a stopper 315 formed in the front thereof to prevent the first insulative housing 11 or the second insulative housing 21 from rotating over the stopper 315. Outer surfaces of the base insulative housing 31, the first insulative housing 11, and the second insulative housing 21 are coplanar when the first plug 12 and second plug 22 are located in the receiving rooms 3101. A front portion of the receiving room 3101 is narrower than a rear portion of the receiving room 3101. The receiving room 3101 has a pair of protrusions 316 formed on inner surfaces of the front portion. When the first plug 12 or the second plug 22 rotates into the receiving room 3101, the protrusions 316 resist against the first plug 12 or the second plug 22 stably. The base plug 32 is electrically connected with the cable 4 by third wires. The base insulative housing 31 includes an upper case 33 and a lower case 34. The upper case 33 includes a first outer wall 331, a first inner wall 332, and a first recess 330 defined between the first outer wall 331 and the first inner wall 332 to receive the first wires, the second wires, the third wires, and a part of the cable 4. The lower case 34 includes a second outer wall 341, a second inner wall 342, and a second recess 340 defined between the second outer wall 341 and the second inner wall 342 to receive the first wires, the second wires, the third wires, and a part of the cable 4.

In this embodiment, the first wires, the second wires, the third wires are connected with the cable 4 directly. In another embodiment, one end of the first wire is connected with wire of the cable 4. One end of the second wire is connected with the other end of the first wire. One end of the third wire is connected with the other end of the first wire.

Steps of assembling the multi-functional transfer connector 100 and the cable 4 comprise:

1. Firstly, assemble the first plug 12 and the first receptacle 13 into the first insulative housing 11; and electrically connect the first plug 12 and the first receptacle 13.

2. Secondly, assemble the second plug 22 and the second receptacle 23 into the second insulative housing 21; and electrically connect the second plug 22 and the second receptacle 23.

3. Then, lay the first insulative housing 11, the second insulative housing 21, the base plug 32, and the cable 4 on the lower case 34.

4. Finally, electrically connect the first plug 12, the first receptacle 13, the second plug 22, the second receptacle 23 and the base plug 32 with the cable 4 directly, and cover the upper case 33 onto the lower case 34.

Figure 7:
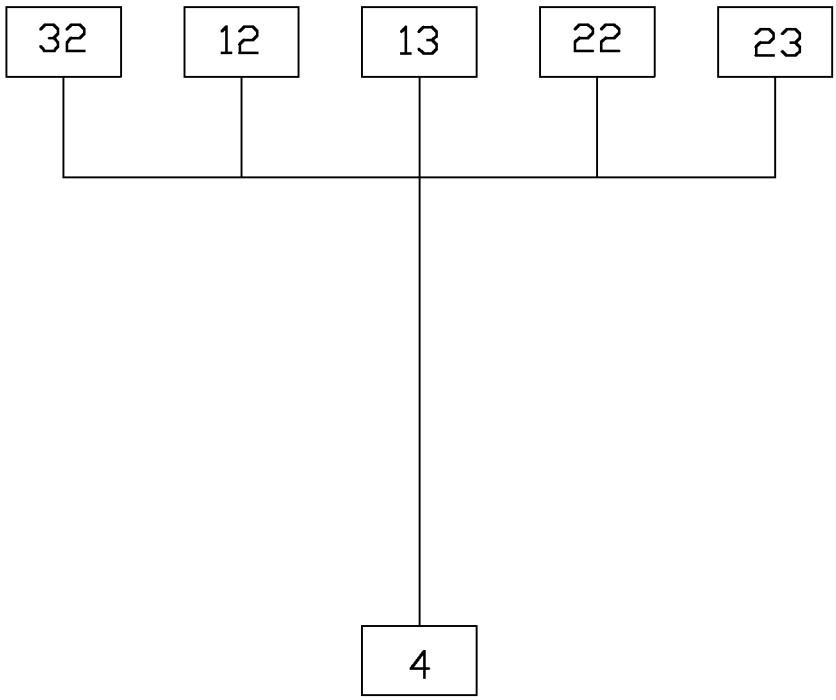
FIG. 7 is a schematic circuit diagram showing electrical connection between the cable and plugs/receptacles of the connector.

Referring to FIG. 7, the first plug 12, the first receptacle 13, the second plug 22, the second receptacle 23, and the base plug 32 are electrically connected with the cable 4 by the first wires, the second wires, and the third wires directly. And there is no IC (Integrated Circuit) between any of the connectors and the cable 4. The first plug 12, the first receptacle 13, the second plug 22, the second receptacle 23, and the base plug 32 are parallel connection. So, the first plug 12, the first receptacle 13, the second plug 22, the second receptacle 23, and the base plug 32 could be used independently. Therefore, when one of the plugs or receptacles is useless, the others of the plugs or receptacles are still available. In other ways, any two of the plugs or the receptacles are connected electrically. So, signals could be transferred between the plugs or the receptacles connecting with two different electronic devices.

The receptacles are electrically connected with the cable 4. A mating plug which is connected with another cable is inserted into the receptacle to prolong the transmission distance. At the same time, OTG (On-The-Go) needs a cable with a plug at one end and a receptacle at the other end. So, the multi-functional transfer connector 100 in accordance to the present invention meets the need of OTG.

In this embodiment, the first plug 12 is a Micro-USB plug. The first receptacle 13 is a Micro-USB receptacle. The second plug 22 is a Mini-USB plug. The second receptacle 23 is a Mini-USB receptacle. In other embodiments, the first plug 12 is a Micro-USB plug. The first receptacle 13 is a Mini-USB receptacle. The second plug 22 is a Mini-USB plug. The second receptacle 23 is a Micro-USB receptacle. So, the first plug 12 and the first receptacle 13 could make signals transfer between a Mini-USB plug and a Micro-USB receptacle in two different electronic devices. The second plug 22 and the second receptacle 23 could make signals transfer between a Micro-USB plug and a Mini-USB receptacle in two different electronic devices.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. A multi-functional transfer connector comprising: a first insulative housing; a first plug and a first receptacle assembled to opposite sides of the first insulative housing;

a base insulative housing defining a peripherally closed receiving space to receive the first insulative housing, the first plug, and the first receptacle;

a base plug retained at a first, outer side of the receiving space of the base insulative housing; and a cable secured to an opposite second, outer side of the receiving space of the base insulative housing; wherein the cable comprises individual wires electrically connecting in parallel to the first plug, the first receptacle, and the base plug directly;

wherein the first insulative housing comprises a pair of pivoted posts, the base insulative housing comprises a pair of openings, and the pivoted posts engage with the openings.

2. The multi-functional transfer connector as claimed in claim 1, wherein the first plug is located in the front of the first insulative housing, the first receptacle is located in the rear of the first insulative housing, and the base plug is located in the front of the base insulative housing.

3. The multi-functional transfer connector as claimed in claim 1, wherein the receiving space defines a lengthwise direction and the first insulative housing and the base insulative housing cooperatively each define an axial direction perpendicular to the lengthwise direction.

4. The multi-functional transfer connector as claimed in claim 3, wherein both the first insulative housing and the base insulative housing define a plurality of holes, associated wires extend through the holes, and the axial directions are defined through corresponding, opposing holes.

5. The multi-functional transfer connector as claimed in claim 4, wherein one of the first insulative housing and the base insulative housing forms a pair of opposing posts, the posts extending into the holes of the other of the first insulative housing and the base insulative housing.

6. The multi-functional transfer connector as claimed in claim 5, wherein the holes on the posts of one of the first insulative housing and the base insulative housing are smaller than those holes of the other of the first insulative housing and the base insulative housing.

7. The multi-functional transfer connector as claimed in claim 1, further comprising a second insulative housing, a second plug, and a second receptacle, and wherein the second plug is retained in the front of the second insulative housing, and the second receptacle is retained in the rear of the second insulative housing.

8. The multi-functional transfer connector as claimed in claim 7, wherein the second plug and the second receptacle are electrically connected with the cable directly, and the first plug, the first receptacle, the second plug, the second receptacle, and the base plug are parallel-connected.

9. The multi-functional transfer connector as claimed in claim 7, wherein the second insulative housing comprises a pair of pivoted posts, the base insulative housing comprises a pair of openings, and the pivoted posts engage with the openings.

10. The multi-functional transfer connector as claimed in claim 9, wherein the second insulative housing defines a hole extending through the pivoted post to let wires which connect the second plug and second receptacle with the cable pass through the hole.

11. The multi-functional transfer connector as claimed in claim 1, wherein the first insulative housing defines a hole extending through the pivoted post to let wires which connect the first plug and the first receptacle with the cable pass through the hole.

12. The multi-functional transfer connector as claimed in claim 11, wherein the base insulative housing comprises an upper case and a lower case, and at least one of the upper case and the lower case comprises an outer wall, an inner wall, and a recess between the outer wall and the inner wall to receive a part of the cable.

13. The multi-functional transfer connector as claimed in claim 11, wherein the receiving space comprises a receiving room, and the receiving room comprises a stopper in the front thereof to prevent the first insulative housing from rotating over the stopper.

14. The multi-functional transfer connector as claimed in claim 13, wherein a front portion of the receiving room is narrower than a rear portion of the receiving room, and the receiving room comprises a pair of protrusions on inner surfaces of the front portion for resisting against the first plug.

15. A multi-functional transfer connector comprising:

a base insulative housing defining a first receiving cavity and a second receiving cavity between two opposite faces thereof in a first direction in a peripherally closed manner, and spaced from each other in a second direction perpendicular to the first direction;

a first connector unit disposed in the first receiving cavity and defining at least a first mating port;

a second connector unit disposed in the second receiving cavity and defining at least a second mating port; and a cable attached to the common housing and enclosing a plurality of wire units, each of said wire units having first and second connecting ends respectively connecting to the first mating port of the first connector unit and the second mating port of the second connector unit so as to have said first connector unit and said second connector unit operated independent from each other;

wherein at least the first mating port of the first connector unit is received in the first receiving cavity without exposure to an exterior in an inoperable manner while available to be rotated out of the first receiving space in the first direction to be exposed to the exterior in an operable manner for mating a base plug; the base plug is located around an outer side of the insulative base housing.

16. The multi-functional transfer connector as claimed in claim 15, wherein said second connector unit is either rotatable or stationary relative to the common housing.

17. The multi-functional transfer connector as claimed in claim 15, wherein a rotation axis about which the first mating port is rotated is perpendicular to both said first direction and said second direction.

18. The multi-functional transfer connector as claimed in claim 17, wherein said first connector unit further defines another mating port opposite to said first mating port, and the rotation axis is located therebetween.

19. The multi-functional transfer connector as claimed in claim 17, wherein the first connector unit defines a hollow pivoted post along said rotation axis, and the wires originally extends beside the first receiving cavity and successively into said hollow pivoted post to connect to the first mating port.

* * * * *